United States Patent [19]

Maxim et al.

[11] Patent Number: 4,568,309

[45] Date of Patent: Feb. 4, 1986

[54] MULTI-ACTION TOY VEHICLE

[75] Inventors: John Maxim, North Stamford, Conn.; Herbert M. Riggs, Medina; Andrew E. Plakos, Bloomington, both of Minn.

[73] Assignee: John Maxim, Bethel, Conn.

[21] Appl. No.: 578,901

[22] Filed: Feb. 10, 1984

[51] Int. Cl.[4] ..... A63H 17/00

[52] U.S. Cl. ..... 446/465; 446/457

[58] Field of Search ..... 446/437, 457, 458, 460–465, 446/470, 431

[56] References Cited

U.S. PATENT DOCUMENTS

| | | | |
|---|---|---|---|
| 1,682,764 | 9/1928 | Mohr | 446/457 X |
| 2,587,052 | 2/1952 | Lohr | 446/464 X |
| 3,634,969 | 1/1972 | Harlting et al. | 446/463 |
| 3,772,824 | 11/1973 | Terzian et al. | 446/429 |
| 4,300,308 | 11/1981 | Ikeda | 446/457 |
| 4,438,589 | 3/1984 | Matsushiro | 446/462 |
| 4,467,557 | 8/1984 | Kuna et al. | 446/463 |

*Primary Examiner*—Mickey Yu

*Attorney, Agent, or Firm*—Blum, Kaplan, Friedman, Silberman & Beran

[57] ABSTRACT

A multi-action toy vehicle which includes a chassis having first and second rear wheels rotatably supported thereon. The toy vehicle includes first and second arms pivotally supported on the chassis proximate the rear wheels, which each include a projection. A weighted lever is movably supported on the chassis, which selectively changes the balance of the toy vehicle depending on the position thereof. The lever also selectively contacts the first and second arms to cause the first and second projections to selectively extend through the chassis. The projections will contact the surface on which the toy vehicle is riding to cause the toy vehicle to perform multiple actions.

18 Claims, 24 Drawing Figures

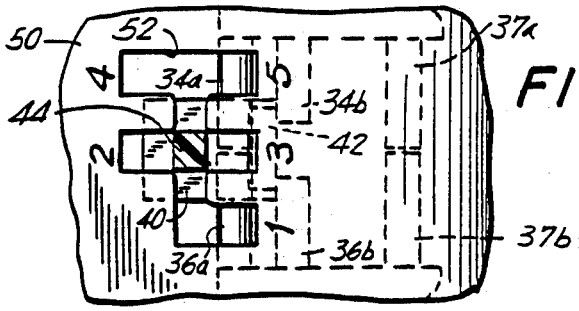
FIG. 6
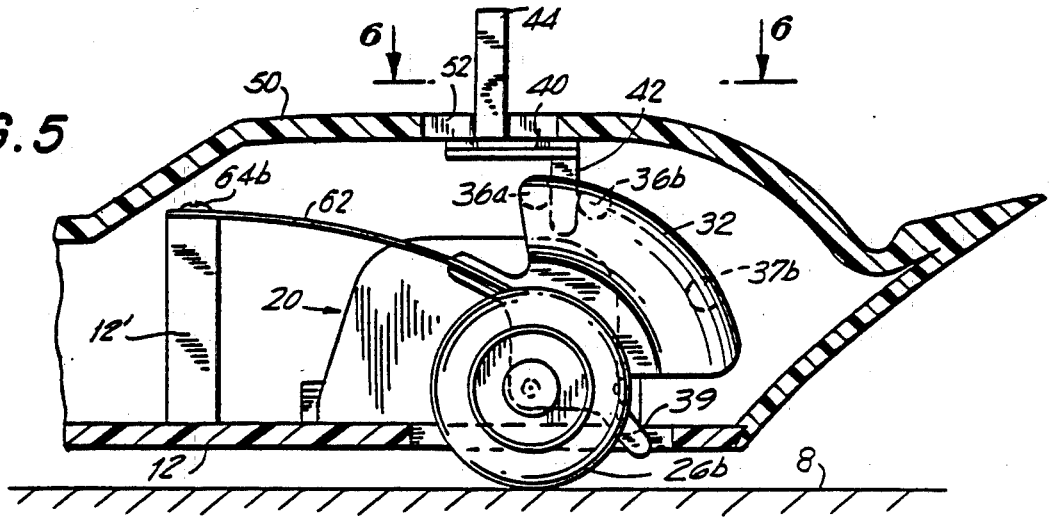
FIG. 5
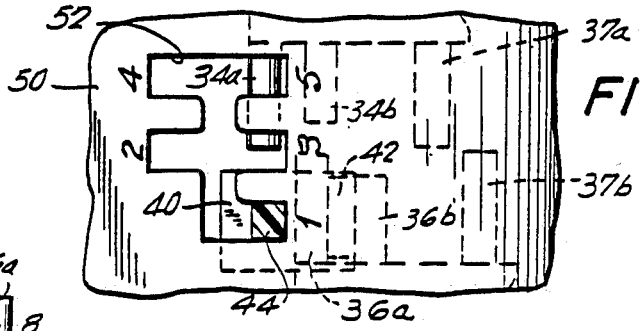
FIG. 8
FIG. 9
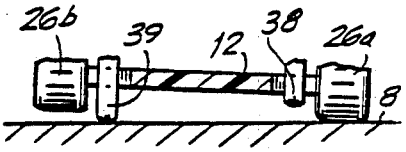
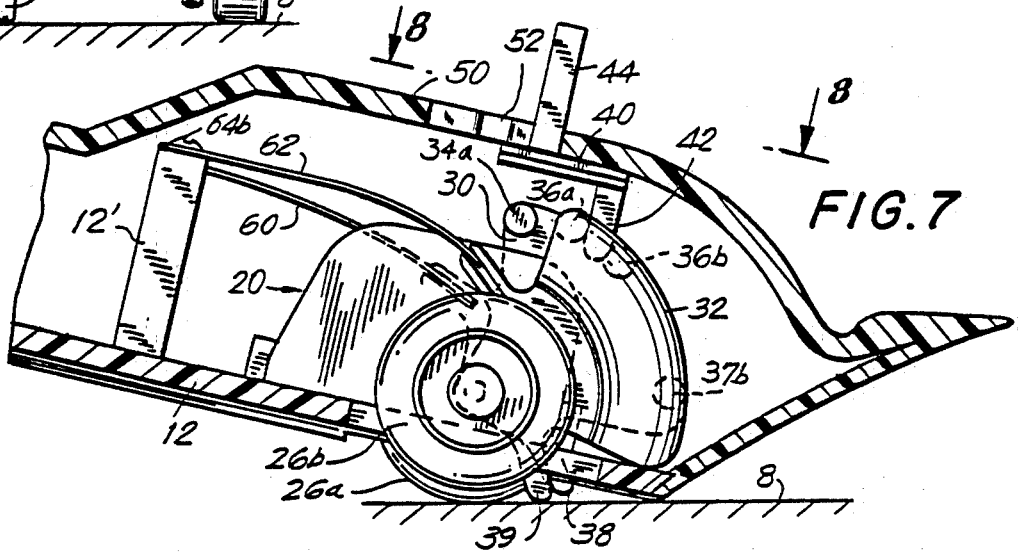
FIG. 7

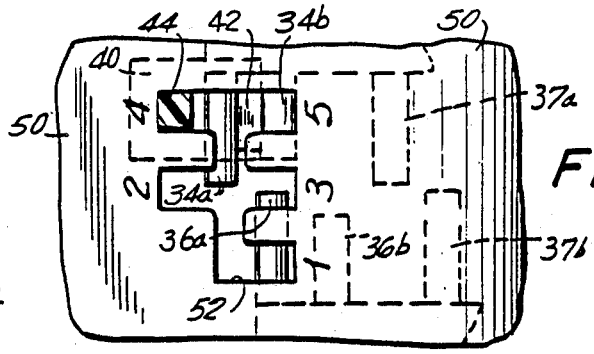
FIG. 17
FIG. 18
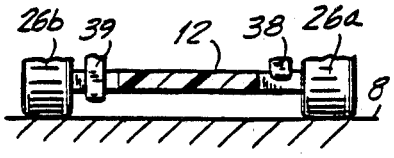
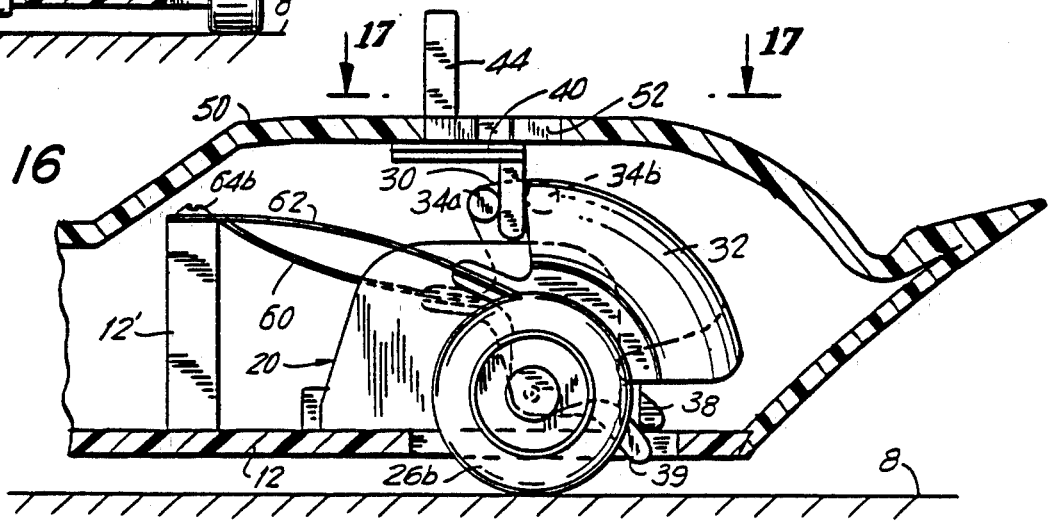
FIG. 16
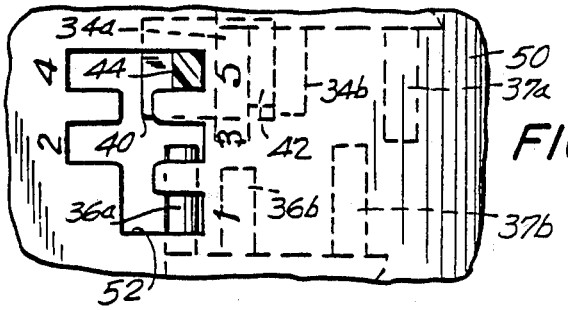
FIG. 20
FIG. 21
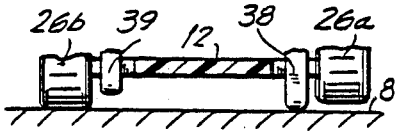
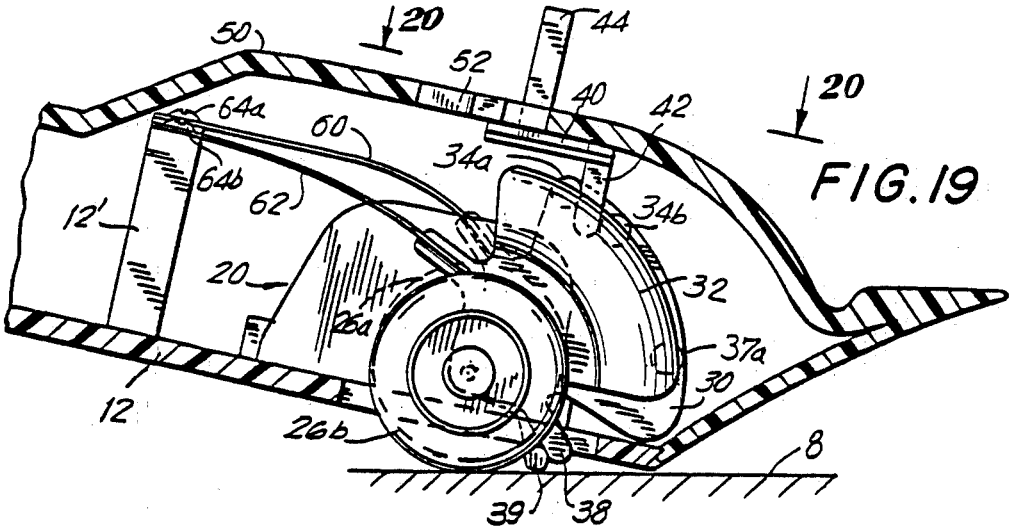
FIG. 19

MULTI-ACTION TOY VEHICLE

BACKGROUND OF THE INVENTION

The present invention is directed to a toy vehicle and, in particular, to a toy vehicle whose physical behavior and operating characteristics can be selectively altered by a child playing with the toy vehicle, preferably by moving a simulated gear-shift lever, which permits the toy vehicle to perform multiple actions depending on the position of the operative components as selected by the shift lever.

Toy vehicles such as toy automobiles which simulate the appearance and operation of real automobiles and which are capable of being self-propelled by an internal motor or the like have become popular with children of all ages. One such type of toy vehicle includes what has been commonly known as a pull-back motor. In such vehicles, the rear wheels of the toy vehicle are coupled to a motor which includes a spring which is tightened as the rear wheels are rolled backwards along a surface. In such fashion, the spring becomes tightened so that when the vehicle is released, the spring will relax and transfer its energy via torque to the rear wheels causing them to rotate in a forward direction to propel the toy vehicle in a forward direction. Mechanisms of the type under discussion are disclosed, for example, in U.S. Pat. Nos. 4,077,156 and 3,798,831. Other than being capable of changing the acceleration and speed of such toy vehicles depending upon the amount of energy stored in the spring, only one type of action, namely forward action on all four wheels, is possible.

John Maxim, one of the present co-inventors, has invented a multi-action toy vehicle having a simulated gear-shift lever, which forms the subject matter of U.S. patent application Ser. No. 06/527,624, filed Aug. 29, 1983. In a first embodiment as disclosed and claimed in that application, the lever selectively actuates weights which are pivotally supported on the vehicle chassis to alter the center of gravity thereof. This action causes the vehicle to perform differently depending on the selected position of the gear-shift lever. The description in Ser. No. 06/527,624 regarding the placing of projections on the pivotable weights constitutes the joint invention of the present inventors.

The present invention as described and claimed herein was developed to improve the multi-action toy vehicle of John Maxim as claimed in the earlier application.

SUMMARY OF THE INVENTION

Generally speaking, in accordance with the instant invention, a toy vehicle is provided which includes a chassis having first and second rear wheels rotatably supported thereon to permit the toy vehicle to roll on a surface. A weighted shift lever is movably supported on the chassis. The positioning of the shift lever on the chassis in selected positions acts to alter the balance of the toy vehicle.

In a preferred embodiment, a first arm having a first projection is movably supported on the chassis proximate the first rear wheel, and a second arm having a second projection is movably supported on the chassis proximate the second rear wheel. The weighted shift lever, in the form of a simulated gear-shift lever, is supported on the chassis and is operatively coupleable to the first and second arms for selectively positioning the arms on the chassis. Movement of the lever changes the center of gravity of the vehicle to permit the vehicle to perform multiple actions. The projections selectively contact the surface on which the vehicle is riding to permit the vehicle to perform multiple actions.

The toy vehicle may include an energy storing mechanism such as a pull-back or wind-up motor to permit the toy vehicle to be self-propelled.

Accordingly, it is an object of the present invention to provide an improved multi-action toy vehicle.

Another object of the present invention is to provide a multi-action toy vehicle in which a weighted simulated gear-shift lever is manually actuatable to change the operating characteristics and physical behavior of the toy vehicle.

A further object of the present invention is to provide a toy vehicle whose operating characteristics such as the center of gravity can be altered in response to manual actuation of a weighted lever to provide the vehicle with multiple actions.

Yet another object of the present invention is to provide a multi-action toy vehicle which includes pivotable arms having projections which selectively project through the chassis of the vehicle.

A still further object of the present invention is to provide a toy vehicle capable of multiple actions which has a greatly enhanced play value.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 5 is a sectional side elevational view similar to FIG. 4 but taken through a different portion of the toy vehicle, with the lever in a neutral position;

FIG. 6 is a sectional view taken along line 6—6 of FIG. 5;

FIG. 7 is a partial side elevational view of the toy vehicle depicted in FIG. 1 performing a wheel stand with the lever in the first gear position;

FIG. 8 is a sectional view taken along line 8—8 of FIG. 7;

FIG. 9 is a partial elevational view of the rear wheels of the toy vehicle depicted in FIG. 7;

FIGS. 16, 17 and 18 are views similar to FIGS. 7, 8 and 9 but depict the vehicle in the fourth gear position;

FIGS. 19, 20 and 21 are views similar to FIGS. 7, 8 and 9 but depict the toy vehicle in the fifth gear position;

DESCRIPTION OF THE PREFERRED EMBODIMENT

Figure 1:
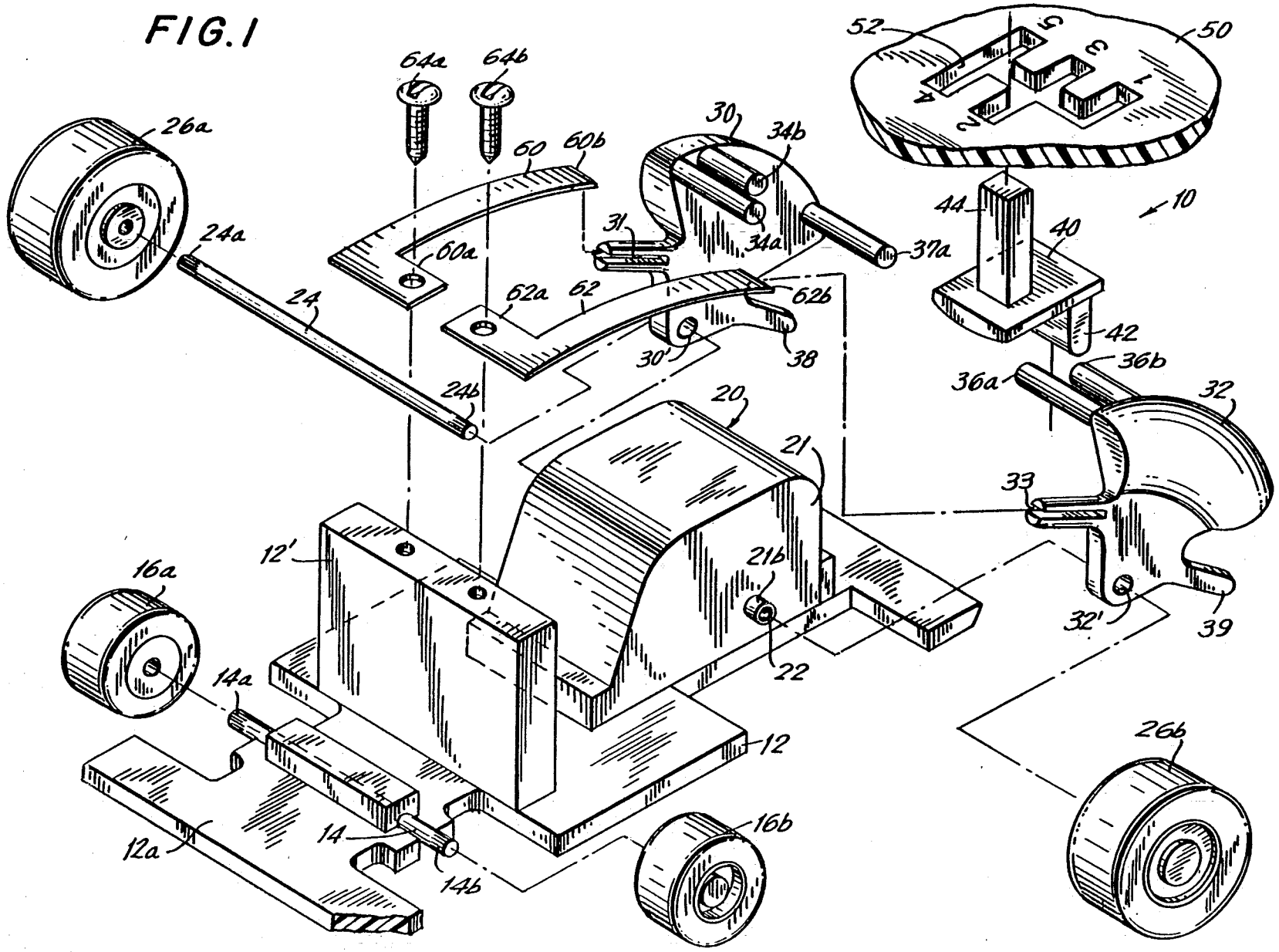
FIG. 1 is an exploded perspective view of a multi-action toy vehicle constructed in accordance with a first embodiment of the present invention, with only a portion of the toy vehicle body being depicted.
Figure 2:
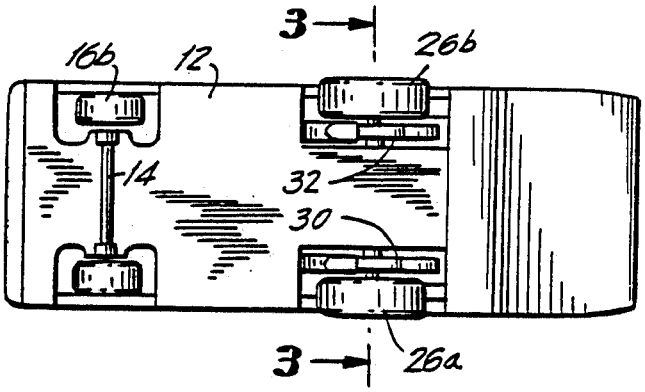
FIG. 2 is a bottom plan view of the toy vehicle depicted in FIG. 1, as constructed.
Figure 3:
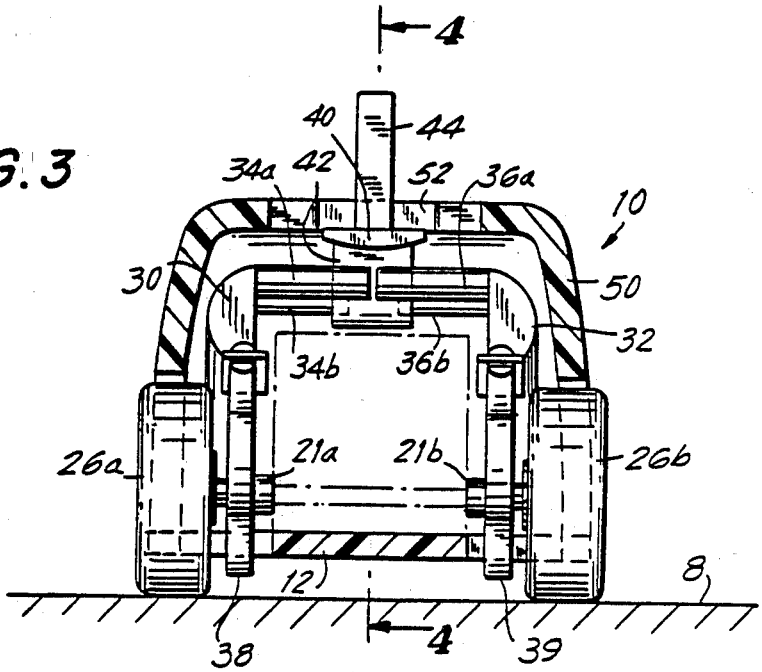
FIG. 3 is an enlarged sectional view taken along line 3—3 of FIG. 2.

Reference is first made to FIGS. 1 through 3 which depict a toy vehicle, generally indicated at 10, constructed in accordance with a first embodiment of the present invention. Toy vehicle 10 includes a toy vehicle frame or chassis 12 on which the several components of toy vehicle 10 are disposed. A front axle 14 is rotatably supported on front end 12*a* of chassis 12. A pair of front wheels 16*a* and 16*b* are secured to opposite ends 14*a* and 14*b*, respectively, of axle 14 so as to be rotatable therewith.

An energy storing mechanism such as a motor 20 is secured to chassis 12. Motor 20 includes a through hole 22 in which a rear axle 24 is inserted. A pair of rear wheels 26*a* and 26*b* are secured to ends 24*a* and 24*b*, respectively, of axle 24 so as to be rotatable therewith.

Motor 20 may be a pull-back motor of the type disclosed in U.S. Pat. Nos. 4,077,156 and 3,798,831 in which a spring is tightened by rolling the rear wheels in a reverse direction over a surface to store energy, which energy, when the vehicle is released, will cause the vehicle to be projected forward. Accordingly, rear axle 24 will be appropriately linked to motor 20 so that torque created thereby can be applied to rear axle 24 to cause it to rotate in a forward direction. It is noted that other types of energy storing mechanisms may be utilized, such as a conventional wind-up motor or the like. However, it is also recognized that the present invention may operate under manual propulsion although a self-propelled toy vehicle is preferable.

First and second weights 30 and 32 are pivotably supported intermediate rear wheels 26*a* and 26*b*, respectively, and motor 20. In this regard, housing 21 of energy storing mechanism 20 may include cylindrical open projections 21*a* and 21*b* which respectively pivotably support weights 30 and 32 through respective openings 30′ and 32′. As will be described below in detail, weights 30 and 32 are pivotable to selected positions to alter the center of gravity of toy vehicle 10 in order to provide vehicle 10 with different operating conditions and physical behavior dependent upon the position of weights 30 and 32.

A simulated gear-shift lever or control knob 40 is provided for selectively positioning weights 30 and 32. Control knob 40 includes a downwardly extending projection 42 which is captured between pegs 34*a* and 34*b* of weight 30 and pegs 36*a* and 36*b* of weight 32. Control knob 40 also includes an upwardly extending rod or lever 44. A toy vehicle body 50 is appropriately coupled to chassis 12. Body 50 includes a cut out pattern or slot 52 in the form of a gear shift pattern and is appropriately marked with indicia such as the numbers 1 through 5 as depicted to denote the plurality of positions and in order to further simulate a gear shift pattern of an actual automobile. Shift lever 44 extends through slot 52 and is movable between the positions indicated.

First and second leaf springs 60 and 62 each have a first end 60*a* and 62*a*, respectively, which is secured to vertical block 12′ on chassis 12 by means of screws 64*a* and 64*b*. Opposite ends 60*b* and 62*b* of leaf springs 60 and 62 extend into slots 31 and 33 formed in weights 30 and 32, respectively. Leaf springs 60 and 62 apply a force to weights 30 and 32 so that they remain in a neutral position, as described below in detail, and which also return weights 30 and 32 to their neutral position when shift lever 44 is returned to its neutral position after being moved from one of the five gear positions. Weights 30 and 32 include additional extending rods 37*a* and 37*b*, respectively, which aid in stabilizing weights 30 and 32 and to insure proper pivoting thereof.

Weights 30 and 32 include projections 38 and 39, respectively, which will contact the surface on which vehicle 10 is riding under certain operating conditions when shift lever 44 is positioned in certain of the gear positions, as will also be described below in detail.

Figure 4:
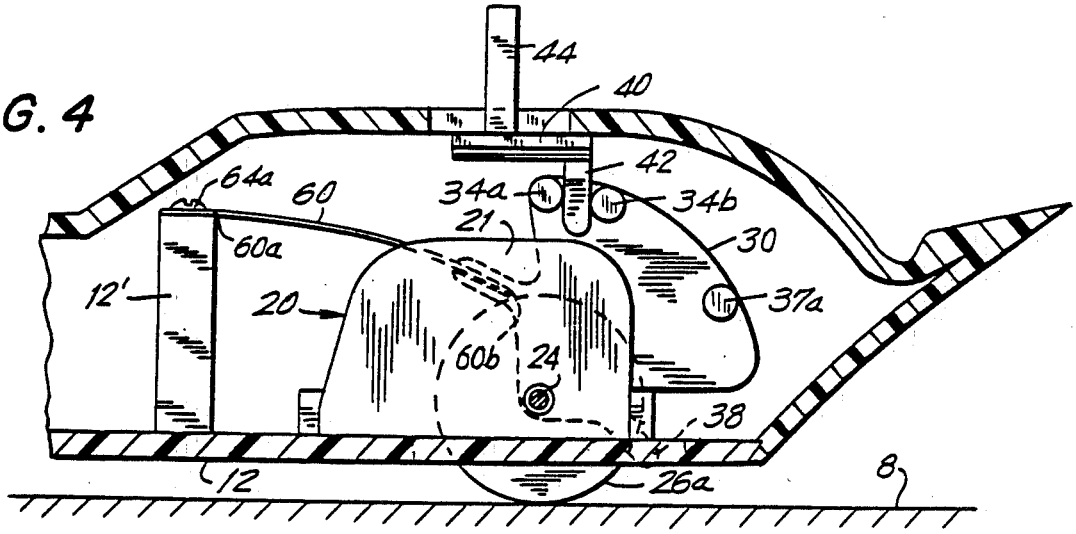
FIG. 4 is a sectional view taken along line 4—4 of FIG. 3.

Reference is now made additionally to FIGS. 3 through 21, in order to describe the use and operation of toy vehicle 10. FIGS. 3 through 5 depict toy vehicle 10 when shift lever 44 is in a neutral position, that is, when shift lever 44 is not set in one of the numbered gear slots as best depicted in FIG. 6. In the neutral position, weights 30 and 32 remain in their central, neutral position as positioned by leaf springs 60 and 62. Projections 38 and 39 on weights 30 and 32 do not substantially extend through chassis 12 and will not contact surface 8 on which toy vehicle 10 is riding even if toy vehicle 10 performs a wheel stand where front end 12*a* of chassis 12 is lifted into the air. The center of gravity of toy vehicle 10 will be in a normal position such that, after torque is applied by motor 20 to rear wheels 26*a* and 26*b*, as toy vehicle 10 moves forward, the vehicle will run straight and will produce a wheel stand if a sufficeint amount of rotational energy is supplied to the rear wheels to cause the front of the toy vehicle to lift up.

When shift lever 44 is moved into the first gear position as depicted in FIGS. 7 through 9, toy vehicle 10 will exhibit a different physical behavior as described hereinafter. It is noted that sufficient friction is provided between slot 52 and shift lever 44 so that shift lever 44 is held in the first gear position until manually forced back to the neutral position. The same is also true for gear positions 2 through 5, where shift lever 44 will be held in those gear positions until manually forced back to the neutral position.

In the first gear position, weight 32 on the left side of toy vehicle 10 is pivoted and locked in a rearward position. Projection 39 protrudes through chassis 12 as best depicted in FIGS. 7 and 9. Since weight 32 is pivoted, the center of gravity of toy vehicle 10 will be shifted back to 50% of its maximum rear position. After motor 20 is energized and toy vehicle 10 is released on a surface 8 to ride in a forward direction, the front wheels of the vehicle will lift off the ground, causing the toy vehicle to perform a wheel stand, and toy vehicle 10 will turn to the left as projection 39 contacts surface 8.

Figure 12:
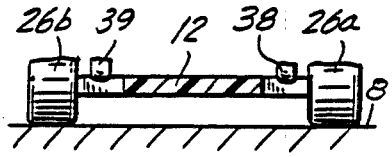
FIGS. 10, 11 and 12 are views similar to FIGS. 7, 8 and 9 but depict the toy vehicle in the second gear position.
Figure 11:
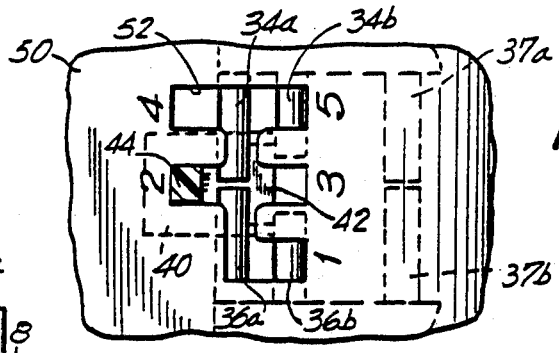
Figure 10:
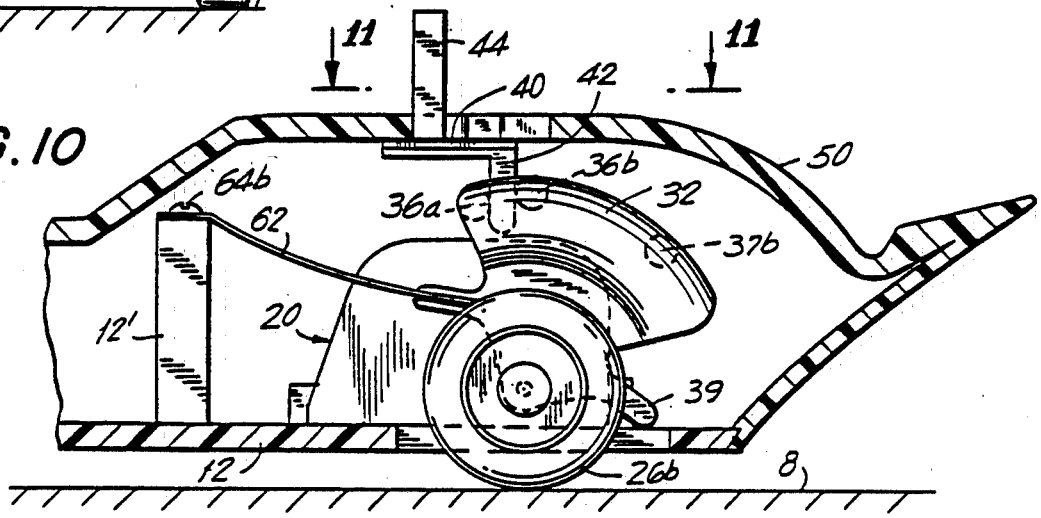

Toy vehicle 10 with shift lever 44 in the second gear postion is depited in FIGS. 10 through 12. In the second gear position, projection 42 contacts both pegs 34*a* of weight 30 and 36*a* of weigh 32, causing weights 30 and 32 to pivot and move in a forward direction. The center of gravity of toy vehicle 10 is moved forward to 100% of its maximum position. Because the center of gravity is moved forward sufficiently, the toy vehicle will run straight when driven by motor 20 and will not perform a wheel stand.

Figure 15:
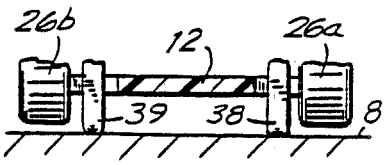
FIGS. 13, 14 and 15 are views similar to FIGS. 7, 8 and 9 but depict the toy vehicle in the third gear position.
Figure 14:
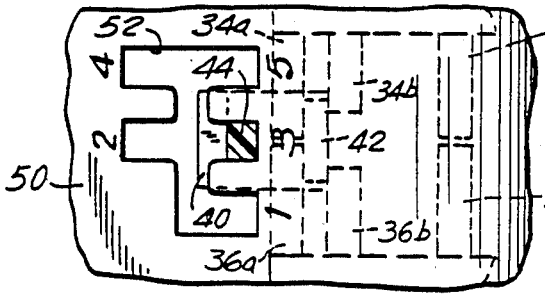
Figure 13:
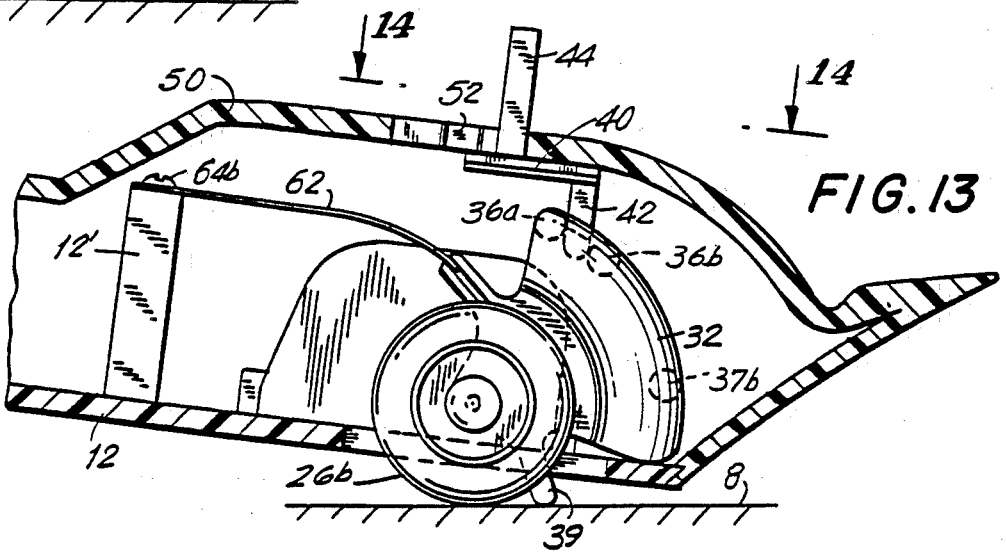

FIGS. 13 through 15 depict toy vehicle 10 when shift lever 44 is moved to the third gear position. In third gear, both weights 30 and 32 are pivoted in the rearward direction, since projection 42 on control knob 40 contacts both pegs 34*b* on weight 30 and 36*b* on weight 32. Both projections 38 and 39 are lowered through chassis 12. The center of gravity of toy vehicle 10 is moved to 100% of its maximum to the rear of the toy vehicle.

As motor 20 causes toy vehicle 10 to move in the forward direction, the front wheels of the toy vehicle will readily lift off the ground and the vehicle will turn right of left depending upon the running surface friction characteristics. In addtion, projections 38 and 39 will contact the ground as toy vehicle 10 perform wheel stands to cause different physical behavior and operating characteristics of the toy vehicle.

In the fourth gear position as depicted in FIGS. 16 through 18, right weight 30 is pivoted forward. The center of gravity of toy vehicle 10 will be moved forward 50% of is maximum, since only one of the weights is pivoted forward. As motor 20 releases its stored energy to the rear wheels, toy vehicle 10 will ride forward with all four wheels on the ground for several feet, whereafter the vehicle will perform a wheel stand.

FIGS. 19 through 21 depict toy vehicle 10 when shift lever 44 is in the fifth gear position. In this position, right weight 30 is pivted to the rear lowering projection 39 thereof below chassis 12 and will contact the ground when a wheel stand is performed. When in fifth gear, the center of gravity of toy vehicle 10 is moved back to 50% of its maximum since only one weight is pivoted to the rear. Toy vehicle 10, when driven by motor 20, will turn to the right as the front wheels are lifted and a wheel stand is perfomed.

In accordance with the above description of a toy vehicle constructed in accordance with the present invention, a multi-action toy vehicle which exhibits different physical behavior and operating characteristics depending upon the position in which the simulated gear shift lever is placed provides an enhanced play value over a regular motorized or propelled toy vehicle. The objects and advantages of the present invention are achieved through a construction as described above, and such a toy vehicle is simple and relatively inexpensive to manufacture. It is noted that the objects and advantages may be obtained in the first embodiment even if a single movable weight is used.

Figure 22:
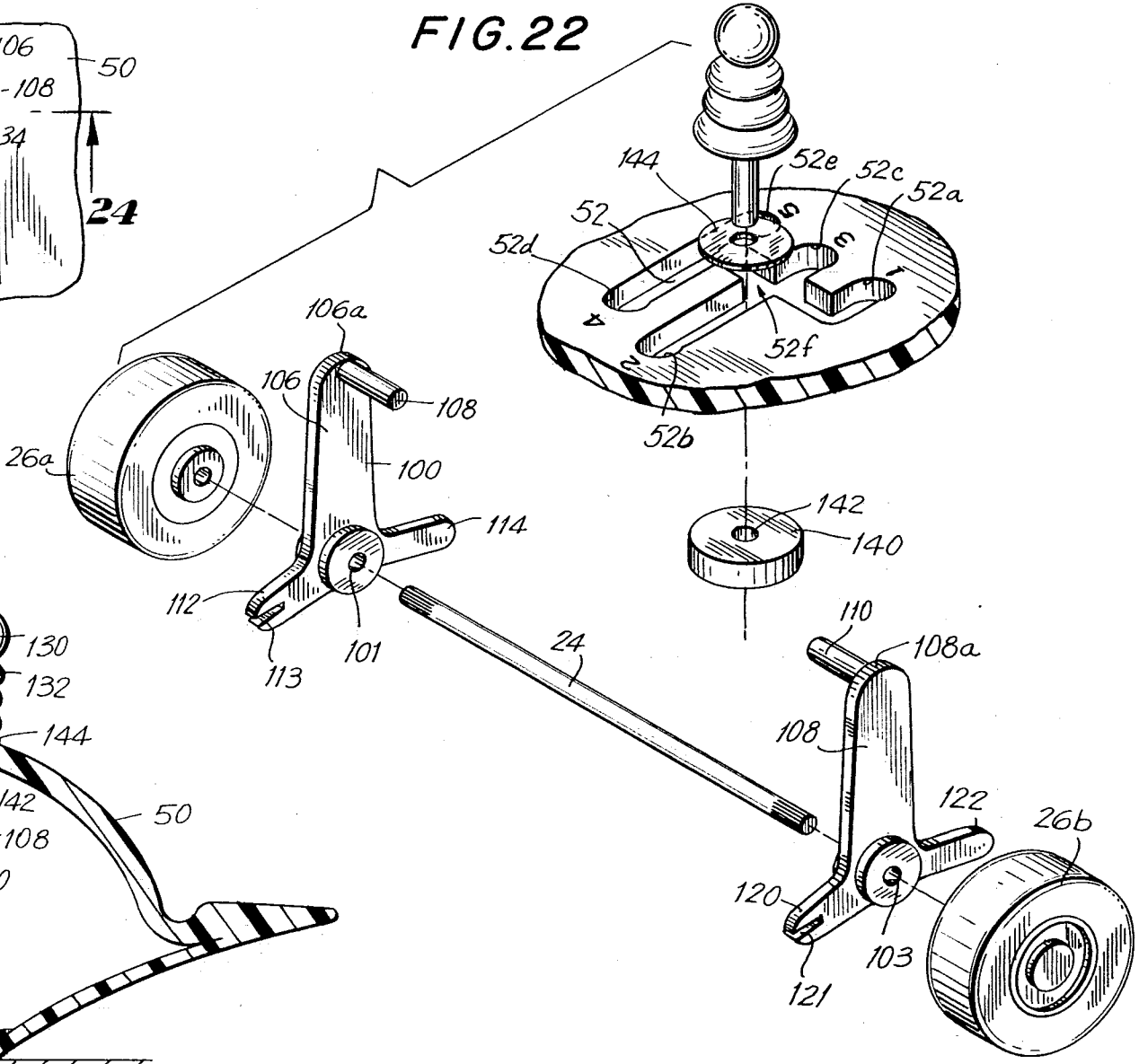
FIG. 22 is an exploded partial perspective view of a preferred embodiment of the present invention.
Figure 23:
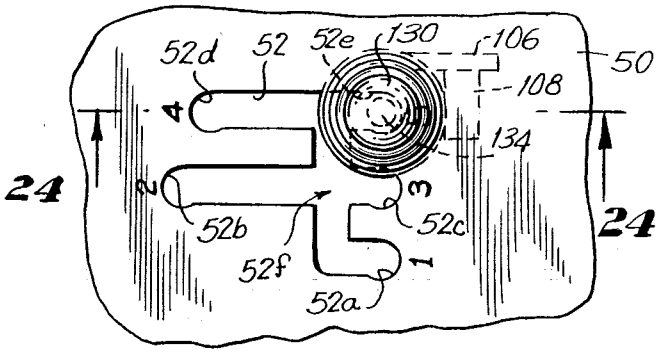
FIG. 23 is a top plan view of the construction depicted in FIG. 22 incorporated in a toy vehicle.
Figure 24:
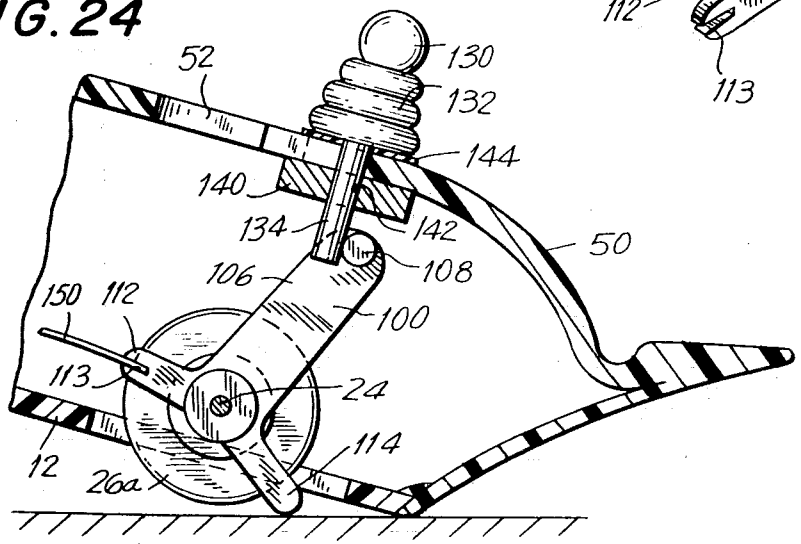
FIG. 24 is a sectional view taken along line 24—24 of FIG. 23.

Reference is now made to FIGS. 22 through 24, which depict a preferred embodiment of the present invention. In this embodiment, T-shaped arms 100 and 102 are pivotally supported on rear axle 24, which extends through openings 101 and 103 in arms 100 and 102, respectively.

Arms 100 and 102 each include an upwardly extending portion 106 and 108, respectively, which respectively include inwardly projecting rods 108 and 110 at the upper ends 106*a* and 108*a* thereof.

Arm 100 includes a first shoulder 112 having a slot 113 formed therein and a second shoulder 114 defining a projection. Similarly, arm 102 includes a shoulder 120 having a slot 121 formed therein and a shoulder 122 defining a projection.

A simulated gear-shift lever or control knob 130 includes an upper weighted portion 132 which permits manual manipulation thereof and an extending rod 134 which extends through slot 52 in the form of a gear-shift pattern in body 50. Slot 52 is slightly narrower than the diameter of rod 134 so that rod 134 will not slip. A disk 140 includes an opening 142 in which shaft 134 of lever 130 is fitted and secured. A washer 144 may also be provided.

When constructed as depicted in FIGS. 22 through 24, weight 132 of lever 130 is adapted to be manually shifted between five shift positions 52*a* through 52*e* plus neutral position 52*f* in pattern 52. It is noted that each of the five shift positions 52*a* through 52*e* are slightly larger than slot 52 so that lever 130 can be releasably locked therein. Disk 140 is adapted to securely, shiftably mount the lever 130 within slot 52. The lower portion of lever 130 is adapted to contact extensions 108 and 110 of arms 100 and 102, respectively, dependent upon the position in which lever 130 is situated.

When in the first gear postion, the lower portion of lever 130 will press against extension 110 to thereby pivot arm 102 such that projection 122 extends through chassis 12 to raise rear wheel 26*b* when the toy vehicle is performing a wheel stand. Since weight 132 is shifted to the rear of the toy vehicle, the addition of this weight to the rear will cause the vehicle to perform a wheel stand.

In the second gear position, weight 132 is shifted forward and the vehicle will move forward on all four wheels.

In the third shift position, weight 132 of lever 130 is shifted to the rear, but the lower portion of lever 130 does not sufficiently contact extensions 108 or 110, and hence, projections 114 and 122 do not project through chassis 12. In third gear, the toy vehicle will perform a wheel stand while traveling in the forward direction.

In the fourth gear position, weight 132 is again shifted forward to the right side of the vehicle. Extensions 108 and 110 are not contacted, and the vehicle will essentially run forward on all four wheels.

In the fifth gear position, weight 132 is shifted to the rear right side of the toy vehicle and the lower portion of lever 130 presses against extension 108 to cause projection 114 to project through the bottom of chassis 12. The vehicle will perform a wheel stand in the forward direction and projection 114 will contact the surface on which the toy vehicle is riding, thereby lifting rear wheel 26*a* off of the ground as depicted in FIG. 24.

It is noted that slots 113 and 121 are provided in arms 100 and 102, respectively, to receive a leaf spring such as leaf spring 150 depicted in FIG. 24. The leaf springs provide a bias to arms 100 and 102 such that they remain in a neutral position when not pressed by disk 140. It is also noted that arms 100 and 102 may be weighted as in the embodiment depicted in FIGS. 1 through 21.

Providing a weighted shift lever on the top of the vehicle and providing projections on the pivotable arms, which may also be weighted, substantially improves the multi-action toy vehicle claimed in earlier U.S. patent application Ser. No. 06/527,624. The toy vehicle of the present invention has enhanced play value and facilitates manufacturing.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A toy vehicle comprising a chassis, first and second rear wheels rotatably supported on said chassis, a weighted shift lever movably supported on said chassis, the positioning of said shift lever on said chassis in selected positions acting to alter the balance of said toy vehicle, a toy vehicle body coupled to said chassis having a slot defining a simulated gear-shift pattern having a plurality of shift positions, said weighted shift lever extending through said slot out of said toy vehicle body to permit manual manipulation thereof, a first arm pivotally supported on said chassis proximate said first rear wheel and a second arm pivotally supported on said chassis proximate said second rear wheel, said shift lever selectively contacting said first and second arms when in selected shift positions.

2. The toy vehicle as claimed in claim 1, wherein said first arm includes a first projection and said second arm includes a second projection which selectively project through said chassis toward the surface on which said toy vehicle is riding depending upon the manner in which said shift lever contacts said first and second arms.

3. The toy vehicle as claimed in claim 2, wherein said shift lever extends through the top of said toy vehicle body.

4. The toy vehicle as claimed in claim 2, wherein said first and second arms are weighted.

5. The toy vehicle as claimed in claim 2, further comprising biasing means for biasing said first and second arms in a selected neutral position.

6. The toy vehicle as claimed in claim 5, wherein said biasing means includes leaf springs coupled intermediate said chassis and said first and second arms.

7. A toy vehicle comprising a chassis, first and second rear wheels rotatably supported on said chassis which permit said toy vehicle to ride on a surface, a first arm having a first projection pivotally supported on said chassis proximate said first rear wheel, a second arm having a second projection pivotally supported on said chassis proximate said second rear wheel, and weighted lever means movably supported on said chassis for selectively changing the balance of said toy vehicle, said lever means selectively contacting said first and second arms to cause said first and second projections to extend through said chassis proximate the surface on which said toy vehicle is riding.

8. The toy vehicle as claimed in claim 7, wherein said first and second arms are weighted.

9. The toy vehicle as claimed in claim 7, further comprising biasing means for normally biasing said first and second arms in a neutral position when not contacted by said lever means.

10. The toy vehicle as claimed in claim 7, further comprising a toy vehicle body supported on said chassis, said toy vehicle body having a slot defining a plurality of positions, said lever means extending through said slot to permit manual manipulation thereof.

11. The toy vehicle as claimed in claim 10, wherein said slot defines a simulated gear-shift pattern, said lever means being a simulated gear-shift lever having a weighted top.

12. The toy vehicle as claimed in claim 11, wherein the weighted top of said shift lever is positioned on the top of said vehicle body.

13. A toy vehicle comprising a chassis, first and second rear wheels rotatably supported on said chassis which permit said toy vehicle to ride on a surface, a first arm having a first projection pivotally supported on said chassis proximate said first rear wheel, a second arm having a second projection pivotally supported on said chassis proximate said second rear wheel, and lever means movably supported on said chassis, said lever means selectively contacting said first and second arms to cause said first and second projections to extend through said chassis proximate the surface on which said toy vehicle is riding.

14. The toy vehicle as claimed in claim 13, wherein said first and second arms are weighted.

15. The toy vehicle as claimed in claim 13, further comprising biasing means for normally biasing said first and second arms in a neutral position when not contacted by said lever means.

16. The toy vehicle as claimed in claim 13, further comprising a toy vehicle body supported on said chassis, said toy vehicle body having a slot defining a plurality of positions, said lever means extending through said slot to permit manual manipulation thereof.

17. The toy vehicle as claimed in claim 16, wherein said slot defines a simulated gear-shift pattern, said lever means being a simulated gear-shift lever.

18. The toy vehicle as claimed in claim 13, said lever being weighted such that shifting of said lever selectively shifts the balance of said toy vehicle.

* * * * *